US006966200B2

(12) United States Patent
Iritani et al.

(10) Patent No.: US 6,966,200 B2
(45) Date of Patent: Nov. 22, 2005

(54) EVAPORATOR AND REFRIGERATOR

(75) Inventors: Yoichiro Iritani, Takasago (JP); Akihiro Kawada, Takasago (JP); Koji Hirokawa, Takasago (JP); Sunao Aoki, Takasago (JP); Yoshinori Shirakata, Nishi-kasugai-gun (JP); Wataru Seki, Nishi-kasugai-gun (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/019,019

(22) PCT Filed: Apr. 26, 2001

(86) PCT No.: PCT/JP01/03625

§ 371 (c)(1),
(2), (4) Date: Dec. 26, 2001

(87) PCT Pub. No.: WO01/81841

PCT Pub. Date: Nov. 1, 2001

(65) Prior Publication Data

US 2002/0157417 A1 Oct. 31, 2002

(30) Foreign Application Priority Data

Apr. 26, 2000 (JP) ..... 2000-126545
Dec. 7, 2000 (JP) ..... 2000-373058

(51) Int. Cl.[7] ..... F25B 39/02; F28D 7/10

(52) U.S. Cl. ..... 62/515; 62/524; 62/526; 165/157

(58) Field of Search ..... 62/515, 524, 526, 62/506; 165/144, 157, 159, 160

(56) References Cited

U.S. PATENT DOCUMENTS

| | | | | |
|---|---|---|---|---|
| 1,769,994 | A | 7/1930 | Hendryx | |
| 1,946,234 | A * | 2/1934 | Price | 165/162 |
| 3,267,693 | A | 8/1966 | Richardson et al. | |
| 4,671,082 | A | 6/1987 | Mochizuki et al. | |
| 4,843,837 | A | 7/1989 | Koike et al. | |
| 5,697,435 | A | 12/1997 | Raleigh et al. | |
| 5,791,404 | A * | 8/1998 | Bailey et al. | 165/159 |
| 5,839,294 | A * | 11/1998 | Chiang et al. | 62/471 |

FOREIGN PATENT DOCUMENTS

| | | |
|---|---|---|
| DE | 3128511 A1 * | 2/1983 |
| DE | 299 398 | 4/1992 |
| EP | 0 504 990 | 9/1992 |
| EP | 0 844 453 | 5/1998 |
| JP | SHO 52-126455 | 9/1977 |
| JP | SHO 54-22265 | 2/1979 |
| JP | HEI 08-254373 | 10/1996 |
| JP | HEI 10-160282 | 6/1998 |
| JP | HEI 10-176874 | 6/1998 |

* cited by examiner

*Primary Examiner*—Chen Wen Jiang
(74) *Attorney, Agent, or Firm*—Oblon, Spivak, McClelland, Maier & Neustadt, P.C.

(57) ABSTRACT

An evaporator is constructed such that bundles of heat exchanger tubes for flowing cold water are disposed inside a container for admitting the cooling medium. When a total cross sectional area of the heat exchanger tubes at various locations in a flow passage of the cold water is compared, the total area in a downstream location is less than a total area in an upstream location of the flow passage. Therefore, even though the temperature differential between the cold water and the cooling medium is small, the flow speeds of the cold water in the downstream tubes become faster than that in the upstream tubes, so that the heat flux is increased and heat transfer rate is improved.

10 Claims, 6 Drawing Sheets

EVAPORATOR AND REFRIGERATOR

TECHNICAL FIELD

The present invention relates an evaporator for cooling a fluid to be cooled (for example, water, brine and the like) by means of heat exchange processes occurring between the fluid and a cooling medium, and to a refrigerator having the evaporator.

BACKGROUND ART

In a large-scale architectural structures, such as buildings, room cooling is carried out by producing cold water using a refrigerator and circulating the cold water through the piping installed inside the building, and cooling the room by heat exchange with the room air.

An example of evaporators provided in a refrigerator is shown in FIG. 6. Such an evaporator is comprised of a cylindrical container 1 for admitting a cooling medium, and containing numerous heat conducting tubes 2 bundled in a zigzag fashion for flowing the cold water.

Heat exchanger tubes 2 are divided into a tube group-a communicating with a cold water entry opening 3, two tube groups-b, -c communicating the water chambers (omitted in the diagram) provided on each end of the container 1, and a tube group-d communicating with a cold water exit opening 4 (equal number of tubes are provided in each group), so that the cold water flowing from the cold water entry opening 3 flows through the tube group-a to reach one water chamber and then reverses the flow through the tube group-b to enter other water chamber and reverses the flow for the second time through the tube group-c to reach the other water chamber and reverses the flow for the third time through the tube group-d to discharge from the cold water exit opening 4. The cold water flows through the tube groups and travels the distance of the container 1 twice, and in the process, it exchanges heat with the cooling medium and is cooled by the cooling medium introduced into the container 1 through a different path. On the other hand, the cooling medium are heated by the cold water to boil and vaporize.

However, the evaporators having such a structure present the following problems.

(1) In the conventional evaporators, the number of heat exchanger tubes within each tube group is the same, and the tube lengths are also the same. However, when those tubes in the upstream environment in the flow direction are compared with those tubes in the downstream environment, the flow speed of the cold water flowing in the tubes is almost constant, but the temperature differential between the cold water flowing inside the tube and the cooling medium flowing on the outside of the tubes is small in the downstream environment so that the heat flux is less compared with the heat flux in the upstream environment, resulting in reducing the rate of heat conduction in the downstream tube groups.

(2) In the upstream tube groups, there is a temperature difference between the cold water flowing in the tube and the cooling medium flowing around the outside of the tube, and the heat conduction flux is larger compared with the heat conduction flux in the upstream side, thereby increasing the heat conduction rate. Although increased heat conduction rate is not a problem in itself, cooling medium is actively vaporized in the vicinity of the upstream tubes to an extent to increase the void factor to impede heat exchange between the liquid phase of the cooling medium and cold water, resulting that heat conduction rate is reduced even in the upstream tube groups.

(3) In the upstream tube groups, the vapor/liquid interface (frost level, or more accurately, an interface between the vapors of the cooling medium and a vapor/liquid two-phase mixture) is raised, while in the downstream tube groups, affected by the rise in the vapor/liquid interface in the upstream tube groups, the vapor/liquid interface is lowered Therefore, if the height of the heat exchanger tubes in the uppermost stage of each tube group are the same, the heat exchanger tubes in the uppermost stage of the downstream tube groups are exposed to vapor phase of the cooling medium, thereby impeding heat exchange between the cooling medium and the cold water, to result in reducing the heat conduction rate even in the downstream tube groups.

DISCLOSURE OF INVENTION

The present invention is provided in view of the background information presented above, and an object is to provide a refrigerator having a high cooling efficiency by increasing the heat conduction rate in the evaporator.

An evaporator and a refrigerator having the following structures are provided as means for achieving the object. That is, an evaporator is comprised by disposing in a container for admitting a cooling medium a plurality of heat exchanger tubes in bundles for flowing a fluid to be cooled, wherein a total cross sectional area of the heat exchanger tubes at a given location in a flow passage of the fluid to be cooled is smaller in a downstream location than in an upstream location of the flow passage.

In the basic version of the evaporator, by reducing the sum of the individual cross sectional areas of the heat exchanger tubes in the downstream side of the flow passage of the fluid to be cooled (object to be cooled), the flow speed of the fluid to be cooled in the downstream side of the flow passage is increased so that the heat flux is increased even though the temperature differential between the fluid to be cooled and the cooling medium is small, so that heat conduction rate is improved even in the downstream tube groups.

According to aspect two of the evaporator, the plurality of heat exchanger tubes are comprised by tubes having a common diameter, and the plurality of heat exchanger tubes are grouped into tube groups so that the flow passage weaves through each tube group successively; and a number of heat exchanger tubes belonging to a downstream side is less than a number of heat exchanger tubes belonging to an upstream side.

In the above evaporator, by reducing the number of heat exchanger tubes belonging to the downstream side relative to the number of heat exchanger tubes belonging to the upstream side, the total cross sectional area of the heat exchanger tubes becomes small to cause an increase in the flow speed of the fluid to be cooled, so that the heat flux is increased as in the basic version of the evaporator, and it becomes possible to improve heat conduction rate even in the downstream tube groups.

According to aspect three of the evaporator, in an evaporator comprised by disposing in a container for admitting a cooling medium a plurality of heat exchanger tubes in bundles for flowing a fluid to be cooled, a separation distance between heat exchanger tubes at a given location in a flow passage of the fluid to be cooled is selected such that an upstream tube separation distance is comparatively wider than a downstream tube separation distance.

In the above evaporator, by widening the separation distance between the tubes in the upstream side of the flow direction of the fluid to be cooled, it becomes easier for the vapors of the cooling medium to rise among the heat exchanger tubes to facilitate heat exchange between the liquid phase of the cooling medium and the cold water so that the heat conduction rate is improved in the upstream side of the flow passage.

According to aspect four of the evaporator, the plurality of heat exchanger tubes are comprised by tubes having a common diameter, and the plurality of heat exchanger tubes are grouped into tube groups so that the flow passage weaves through each tube group successively; and a separation distance of those heat exchanger tubes of the plurality of heat exchanger tubes located in an upstream side is wider than a separation distance of those heat exchanger tubes located in a downstream side.

In the above evaporator, by widening the separation distance between the tubes in the tube groups in the upstream side relative to the tubes in the tube groups in the downstream side, it becomes easier for the vapors of the cooling medium to rise among the heat exchanger tubes to facilitate exchange of heat between the liquid phase of the cooling medium and the cold water so that the heat conduction rate is improved in the tube groups in the upstream side also.

According to aspect five of the evaporator, heat exchanger tubes located in an uppermost stage of each tube group are disposed in such a way that those upper most tubes located in an upstream tube group are higher than those uppermost tubes located in a downstream tube group, and a stacking height becomes gradually lower towards the downstream tube groups.

In the above evaporator, by arranging the heat exchanger tubes in the uppermost stage of each tube group in such a way that the upstream side tubes are successively higher than the downstream side tubes, even if the level of vapor/liquid interface in the upstream side rises to cause lowering of the vapor/liquid interface level in the downstream side, there is no danger that the uppermost tubes will be exposed in the vapor phase of the cooling medium. Therefore, heat exchange between the liquid phase of the cooling medium and the cold water is facilitated, so that the heat conduction rate is improved even in the tube groups in the downstream side.

The refrigerator of the present invention is comprised by: the basic evaporator or an evaporator that includes any of aspects two to five; a compressor for compressing a vaporized cooling medium; a condenser for condensing and liquefying a compressed cooling medium in a vaporized state; and an expansion valve for reducing a pressure of the cooling medium during a process of flowing a liquefied cooling medium to the evaporator.

In the above refrigerator, heat conduction rates through the heat exchanger tubes in the evaporator are improved as described above, thereby improving the heat exchange efficiency and resulting in achieving a level of performance equivalent to that of the conventional refrigerator, even if the energy consumption is reduced.

BEST MODE FOR CARRYING OUT THE INVENTION

An evaporator and a refrigerator in a first embodiment will be explained with reference to FIGS. 1 and 2.

Figure 1:
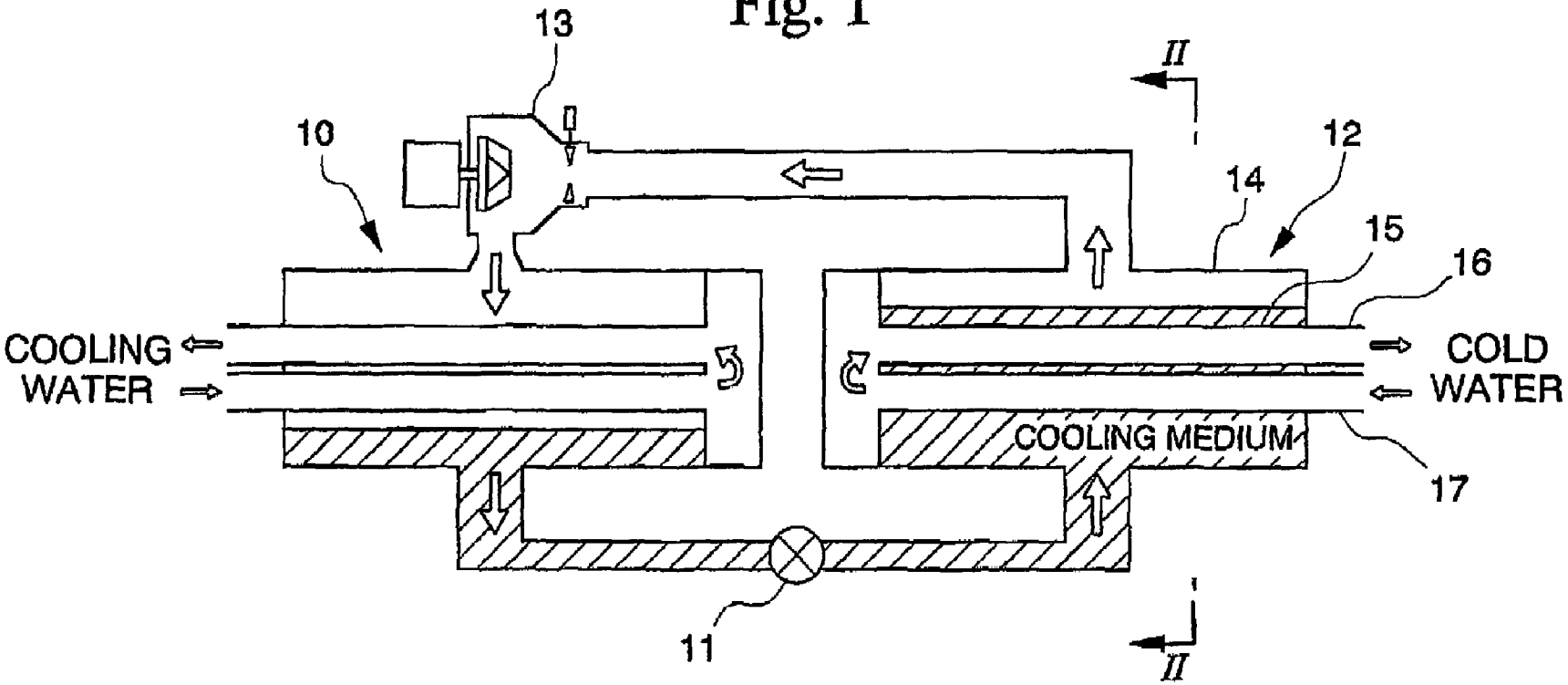
FIG. 1 is a schematic diagram of a refrigerator in a first embodiment of the present invention.

A schematic view of the structure of the refrigerator is shown in FIG. 1. The refrigerator shown in FIG. 1 is comprised by: a condenser 10 for condensing and liquefying a cooling medium by heat exchange between spent water and vapor state cooling medium; an expansion valve 11 for reducing the pressure of the condensed cooling medium; an evaporator 12 for cooling the cold water by heat exchange between the condensed cooling medium and the cold water (fluid to be cooled), and for vaporizing the cooling medium; and a compressor 13 for compressing the vaporized cooling medium and supplying the compressed cooling medium to the condenser. The refrigerator produces cold water by means of the evaporator 12, and uses the cold water for air conditioning and the like for buildings.

The evaporator 12 is constructed such that numerous heat exchanger tubes 15 are bundled inside a cylindrical container 14 (simplified arrangement is shown in FIG. 1), along the longitudinal direction of the container 14 in which a cooling medium is circulated.

Figure 2:
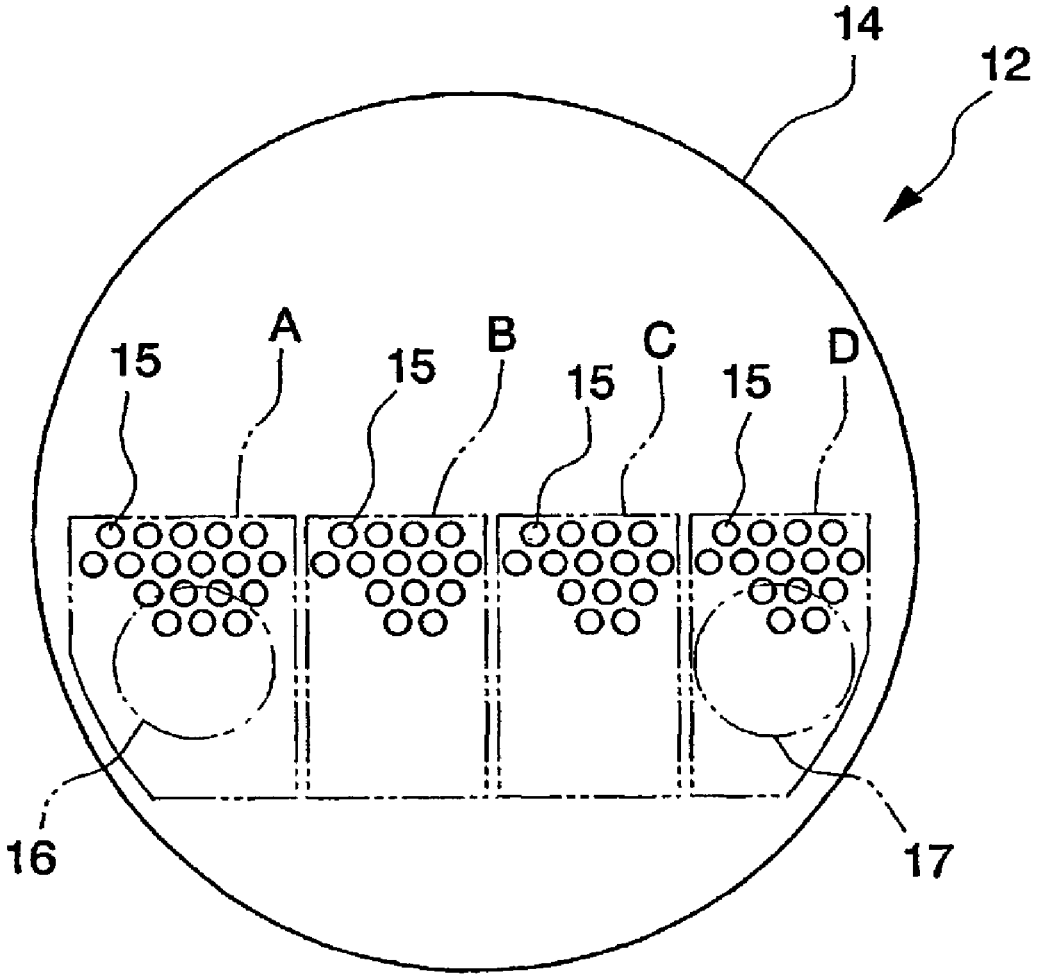
FIG. 2 is a cross sectional view of an evaporator seen through a plane II-II in FIG. 1.

FIG. 2 shows a cross sectional view of the evaporator 12. Heat exchanger tubes 15 are made of metal tubes having a common diameter, and are disposed inside in a zigzag pattern. Also, the heat exchanger tubes 15 are grouped into four tube groups A to D, and the path of the cold water is made to weave through the tube groups A to D successively by subdividing the water chambers (omitted from the diagram) provided at each end of the container 14.

In more detail, one end of the cold water entry opening 16 communicates with one end (front side of the paper of FIG. 2) of the heat exchanger tubes 15 belonging to group A, and other end (back side of the paper of the same) of heat exchanger tubes 15 belonging to group A communicates with other end of heat exchanger tubes 15 belonging to group B, and one end of heat exchanger tubes 15 belonging to group B communicates with one ends of heat exchanger tubes 15 belonging to group C, and other end of heat exchanger tubes 15 belonging to group C communicates with other end of heat exchanger tubes belonging to group D, and one end of heat exchanger tubes 15 belonging to group D communicates with the cold water exit opening 17, so that the cold water flows twice through the interior of the container 14.

A feature of the evaporator 12 in this embodiment is that the number of heat exchanger tubes 15 belonging to group D, which are in the downstream side of the flow passage of the cold water, is made less than any of heat exchanger tubes 15 belonging to tube groups A to C.

Also, in the evaporator 12 in this embodiment, the difference in the number of heat exchanger tubes 15 belonging to tube group D and those in other tube groups is allotted to tube group A such that the number of heat exchanger tubes 15 belonging to tube group A is increased, but the total number of heat exchanger tubes 15 is kept the same as that in the conventional evaporator.

In the evaporator 12 constructed in such a manner, allotment of heat exchanger tubes 15 belonging to tube groups A to D is altered such that the number of heat exchanger tubes 15 in tube group D is decreased while the number of heat exchanger tubes in tube group A is increased so that, when the total cross sectional areas of the flow passages in the heat exchanger tubes 15 are compared, the flow area in the downstream side tubes is less than that of the upstream side tubes in the flow passage.

Because the flow volume of the cold water is essentially unchanged in the upstream or downstream side, the result is that the flow speed in the downstream side of the flow passage is faster than that in the upstream side of the flow passage, so that even in the downstream side where the temperature differential is small, the heat flux is increased to result in improved rate of heat conduction.

Further, regarding the refrigerator 12, cooling efficiency is increased by adopting the structure described above to increase heat conduction rate.

Heat exchanger tubes are divided into four tube groups in this embodiment, but it is permissible to divide the tubes into a smaller number of tube groups or conversely in a larger number of tube groups, depending on the size of the evaporator itself or the performance demanded of the evaporator. Also, in this embodiment, the number of heat exchanger tubes 15 is decreased in the tube group D and the number of heat exchanger tubes in tube group A is increased, other variations may be adopted For example, the number of heat exchanger tubes 15 may be decreased gradually in the tube groups A to D, or the number of heat exchanger tubes 15 may be decreased in tube group D only.

Also, the cross sectional area of the flow passage is reduced by reducing the number of heat exchanger tubes 15 in this embodiment, however, it can be expected that similar effects can be obtained by reducing the diameter of heat exchanger tubes 15 while leaving the number unchanged.

Additionally, it is clear that various other shapes can be adopted for heat exchanger tubes 15 such as dimpled tubing or fin tubing.

Next, a second embodiment of the present invention will be explained with reference to FIGS. 3 and 4. Those parts in the second embodiment that are the same as those in the first embodiment are referred to by the same reference numerals, and their explanations are omitted.

Figure 3:
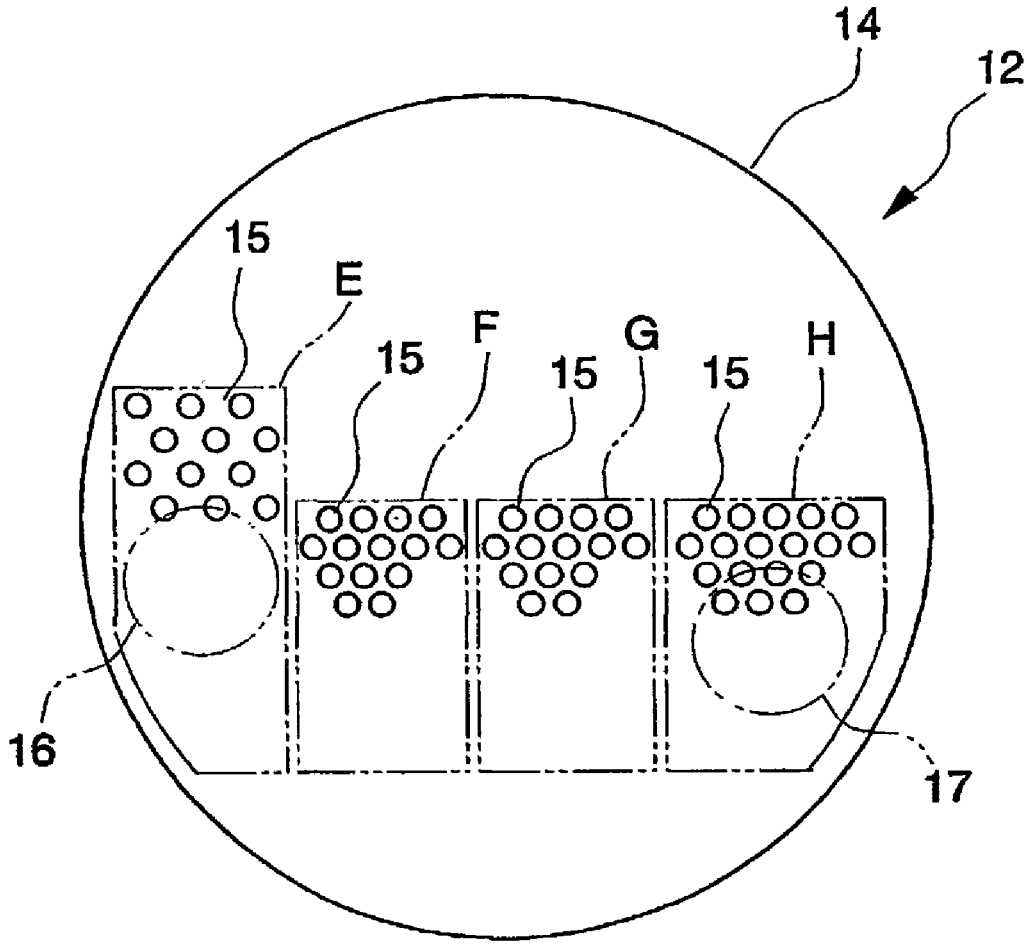
FIG. 3 is a cross sectional view of an evaporator in a second embodiment.
Figure 4:
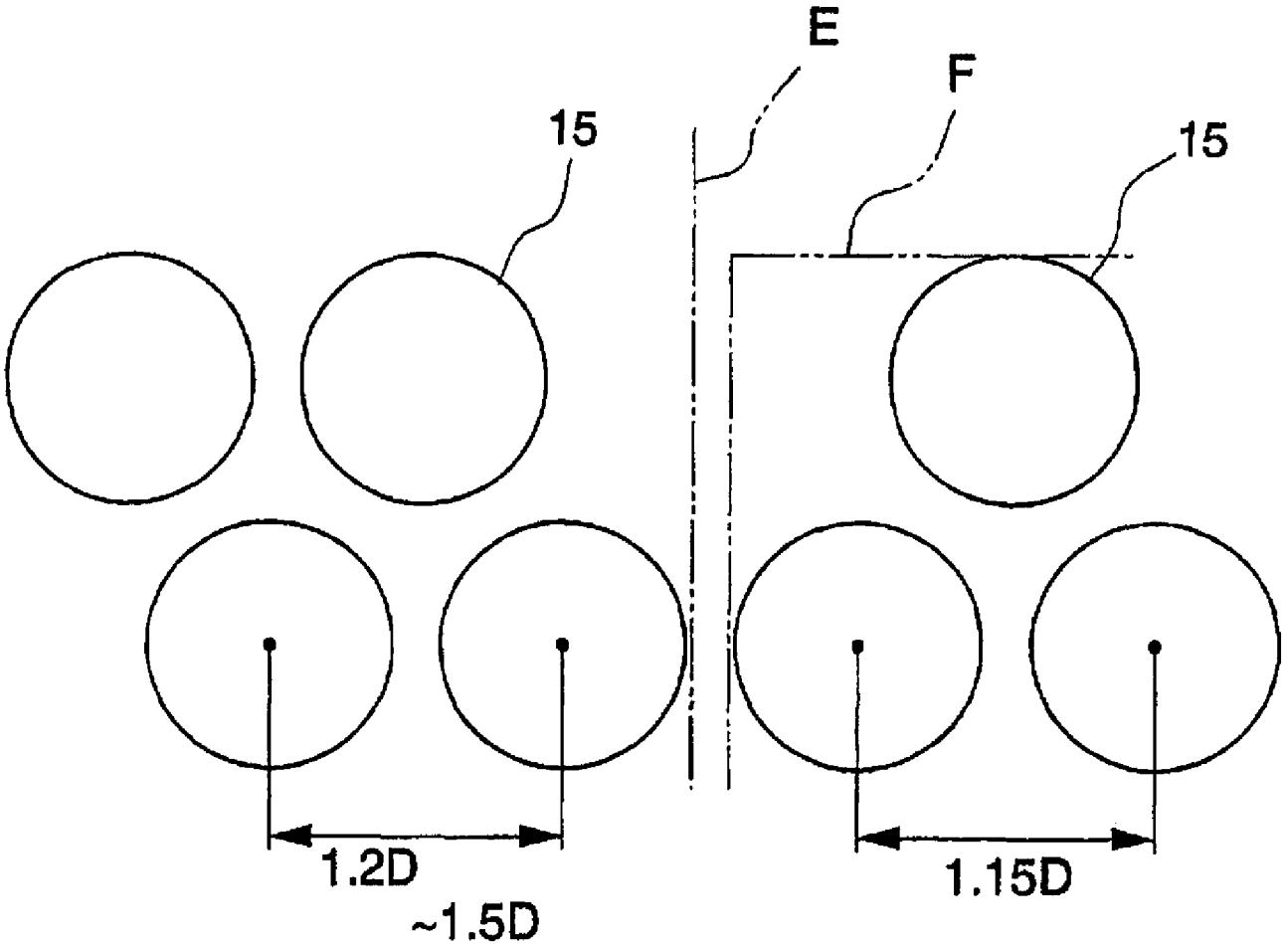
FIG. 4 is a diagram to show positioning of the heat exchanger tubes inside the evaporator.

FIG. 3 shows a cross sectional view of an evaporator 12. Similar to the first embodiment, tubes of a common diameter are used for heat exchanger tubes 15, and they are divided into four tube groups B to H, and the water chamber (omitted from the diagram) provided at each end of the container 14 is subdivided into sections so that the flow passage of the cold water weaves successively through the tube groups E to H.

A feature of the evaporator 12 in the second embodiment is that the separation distance between heat exchanger tubes 15 in tube group E, which is located in the upstream side of the flow passage, is increased compared to heat exchanger tubes in other tube groups F to H. As shown in FIG. 4, the separation distance between heat exchanger tubes 15 is expressed as 1.1 5 D, where d is the diameter of heat exchanger tube 15, in the tube groups F to H, but it is in a range of 1.2 D to 1.5 D in the tube group E.

Also, in the evaporator 12 in this embodiment, accompanying the increase in the separation distance between heat exchanger tubes 15 in tube group E, the overall tube group E has been elevated as seen in the cross sectional view of the arrangement of the tubes in the evaporator 12.

In the evaporator 12 constructed in such a manner, by increasing the separation distance of the heat exchanger tubes 15 in tube group E, vapors of the cooling medium can rise among the heat exchanger tubes 15 more readily. Accordingly, the bubbles of the cooling medium that congregated by clinging about the heat exchanger tubes 15 can now float through between the heat exchanger tubes 15, thus reducing the number of bubbles clinging to the outer periphery of the heat exchanger tubes 15 to facilitate heat exchange between the liquid phase of the cooling medium and the cold water flowing inside the heat exchanger tubes 15, and thereby improving the heat conduction even in the tube group F.

Further, regarding the refrigerator 12, cooling efficiency is increased by adopting the structure described above for the refrigerator 12 to increase heat conduction rate.

Heat exchanger tubes are divided into four tube groups in this embodiment, but it is permissible to divide the tubes into a smaller number of tube groups or conversely in a larger number of tube groups, depending on the size of the evaporator itself or the performance demanded of the evaporator. Further, although the separation distance of heat exchanger tubes 15 was increased only for those tubes, belonging to the tube group E, it is permissible to increase the separation distance of heat exchanger tubes 15 successively through the tube groups E to H such that the separation distance is wider in the tube groups in upstream side and is narrower in the tube groups in the downstream side.

Also, the separation distance of heat exchanger tubes 15 in the tube group E is chosen in a range of 12 D to 1.5 D, but it is not necessary to limit to this range, and other suitable valves may be chosen depending on various conditions required of the evaporator itself or refrigerator. However, when it is necessary to raise the level of the tube groups resulting from increasing the separation distance, it should be noted that it is necessary to secure a space sufficient for installing a de-mister (omitted from the diagram) to remove the liquid component from the container 14.

Next, a third embodiment of the present invention will be explained with reference to FIG. 5. Those parts in the third embodiment that are the same as those in the previous embodiments are referred to by the same reference numerals, and their explanations are omitted.

Figure 5:
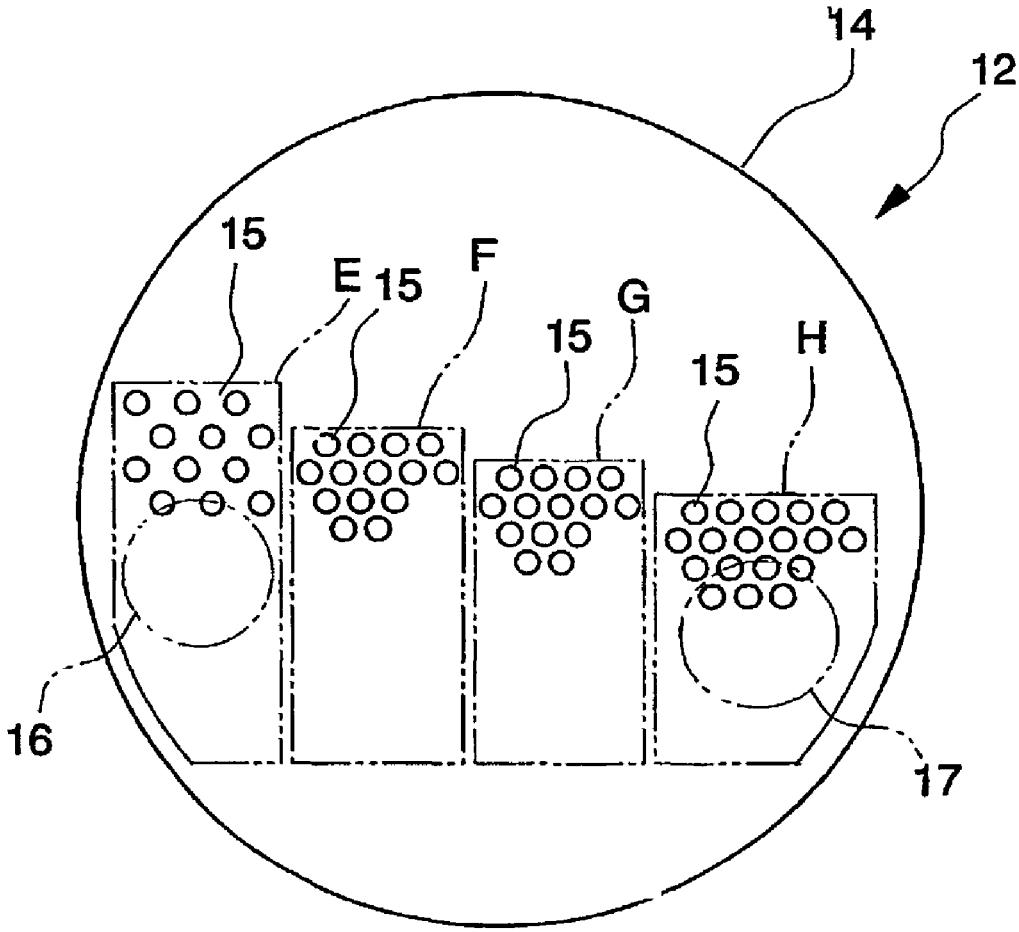
FIG. 5 is a cross sectional view of an evaporator in a third embodiment
Figure 6:
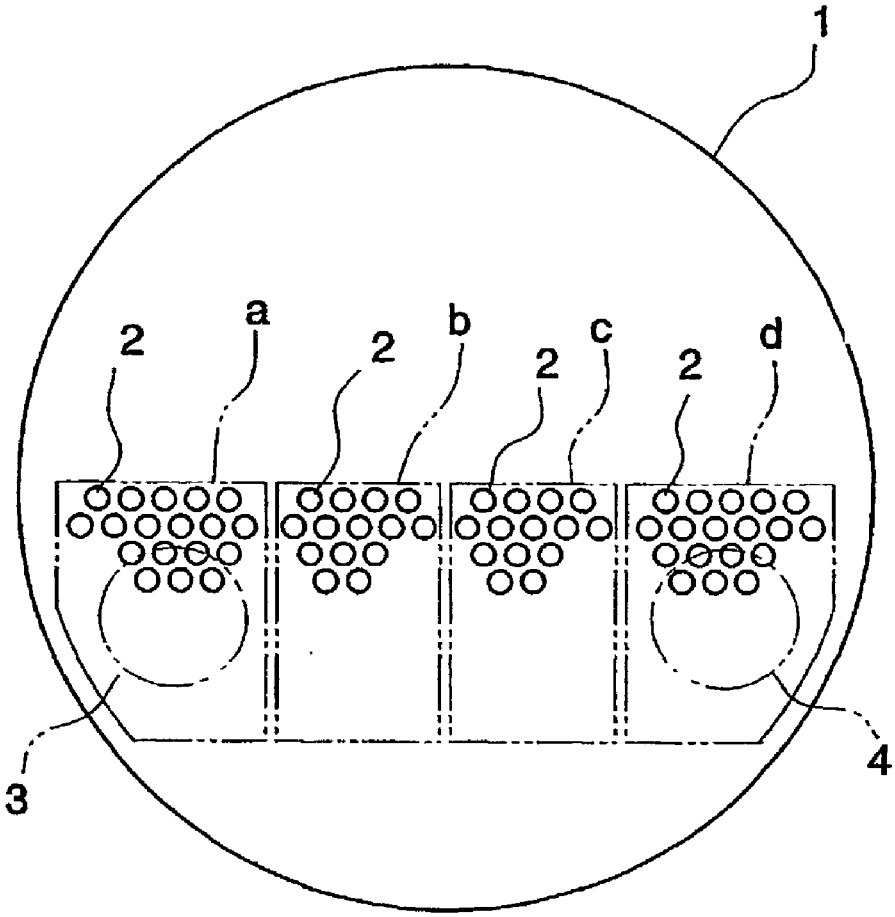
FIG. 6 is a cross sectional view of a conventional evaporator provided in a refrigerator.

FIG. 5 shows a cross sectional view of an evaporator 12. Similar to the first and second embodiments, tubes of a common diameter are used for heat exchanger tubes 15, and they are divided into four tube groups E to H, and the water chamber (omitted from the diagram) provided at each end of the container 14 is subdivided into sections so that the flow passage of the cold water weaves successively through the tube groups E to H.

A feature of the evaporator 12 in the third embodiment is that, of the tube groups E to H, heat exchanger tubes 15 disposed at the uppermost stage in the tube group E, which is in the upstream side of the flow passage of the cold water are at the highest location within the container 14 compared to corresponding heat exchanger tubes 15 in the tube groups E to H, such that the location of the uppermost heat exchanger tubes 15 becomes lower as the cold water weaves through the downstream tube groups in the order F→G→H.

In the evaporator constructed in such a manner, by arranging the heat exchanger tubes 15 in such a way that those in the uppermost stage in each tube group E to H are at the highest location within the respective tube group, and the locations of the uppermost heat exchanger tubes 15 in the tube groups E to H in the upstream side are higher than those in the downstream side. In such an arrangement, even if the vapor/liquid interface in each tube group (F, G, H) is lowered, as a result of a rise in the elevation of the vapor/liquid interface in the tube group E in the upstream side, heat exchanger tubes 15 in the uppermost stage are not exposed in the vapor phase of the cooling medium Accordingly, heat exchange between the liquid phase of the cooling medium and the cold water is facilitated so that heat conduction in each tube group is improved even in the downstream side.

Further, regarding the refrigerator 12, cooling efficiency is increased by adopting the structure described above for the refrigerator 12 to increase heat conduction rate.

To elevate the location of heat exchanger tubes 15 in the uppermost stage in each of the tube groups E to H, it is permissible to increase the separation distance of heat exchanger tubes 15 or to increase the number of heat exchanger tubes 15.

As described above, according to the present evaporator, by reducing the total cross sectional area of the heat exchanger tubes in the downstream side of the flow passage of the fluid to be cooled (object to be cooled), the flow speed of the fluid to be cooled in the downstream side of the flow passage is increased so that the heat flux is increased even though the temperature differential between the fluid to be cooled and the cold water is small. Accordingly, heat conduction rate is improved even in the downstream tube groups.

According to aspect two of the evaporator, by reducing the number of heat exchanger tubes belonging to the downstream side relative to the number of heat exchanger tubes belonging to the upstream side, the total cross sectional area of the heat exchanger tubes becomes small to cause an increase in the flow speed of the fluid to be cooled, even though the temperature differential between the fluid to be cooled and the cooling medium is low, the heat flux is increased. Therefore, it becomes possible to improve heat conduction rate even in the downstream tube groups.

According to aspect three of the evaporator, by widening the separation distance between the tubes in the upstream side of the flow direction of the fluid to be cooled, it becomes easier for the vapors of the cooling medium to rise among the heat exchanger tubes to facilitate heat exchange between the liquid phase of the cooling medium and the cold water so that the heat conduction rate is improved in the upstream side of the flow passage.

According to aspect four of the evaporator, by widening the separation distance between the tubes in the tube groups in the upstream side relative to the tubes in the tube groups in the downstream side, it becomes easier for the vapors of the cooling medium to rise among the heat exchanger tubes to facilitate heat exchange between the liquid phase of the cooling medium and the cold water so that the heat conduction rate is improved in the tube groups in the upstream side.

According to aspect five of the evaporator, by arranging the heat exchanger tubes in the uppermost stage of each tube group in such a way that the upstream side tubes are successively higher than the downstream side tubes, even if the level of vapor/liquid interface in the upstream side rises to cause lowering of the vapor/liquid interface level in the downstream side, there is no danger that the uppermost tubes will be exposed in the vapor phase of the cooling medium. Therefore, heat exchange between the liquid phase of the cooling medium and the cold water is facilitated, so that the heat conduction rate is improved even in the tube groups in the downstream side.

According to the refrigerator of the present invention, heat conduction rates through the heat exchanger tubes in the evaporator are improved as described above, thereby improving the heat exchange efficiency and resulting in achieving a level of performance equivalent to the conventional refrigerator, even if the energy consumption is reduced.

INDUSTRIAL APPLICABILITY

The present invention is applicable to an evaporator for cooling a fluid to be cooled by means of heat exchange processes occurring between the fluid and a cooling medium, and to a refrigerator having the evaporator. In the evaporator of the present invention, by reducing the total cross sectional area of the heat exchanger tubes in the downstream side of the flow passage of the fluid to be cooled (object to be cooled), the flow speed of the fluid to be cooled in the downstream side of the flow passage is increased so that the heat flux is increased even though the temperature differential between the fluid to be cooled and the cold water is small. Accordingly, heat conduction rate is improved even in the downstream tube groups.

What is claimed is :

1. An evaporator comprising:

a container in which a cooling medium is applied; and a plurality of heat exchanger tubes arranged in the container in a bundled manner to form a flow passage through which a fluid to be cooled flows so as to evaporate the cooling medium by heat exchange between the cooling medium and the fluid to be cooled, wherein a total cross sectional area of the heat exchanger tubes at a given location in a downstream section of the flow passage is smaller than a total cross sectional area of the heat exchanger tubes in an upstream section of the flow passage at said given location, the heat exchanger tubes are arranged horizontally, and the position of uppermost heat exchanger tubes in the upstream section is higher than the position of uppermost heat exchanger tubes in the downstream section.

2. An evaporator comprising:

a container in which a cooling medium is applied; and a plurality of heat exchanger tubes arranged in the container in a bundled manner to form a flow passage through which a fluid to be cooled flows so as to evaporate the cooling medium by heat exchange between the cooling medium and the fluid to be cooled, wherein a total cross-sectional area of the heat exchanger tubes in a downstream section of the flow passage is smaller than a total cross-sectional area of the heat exchanger tubes in an upstream section of the flow passage, the plurality of heat exchanger tubes have a common diameter, the flow passage comprises the downstream section and the upstream section, the number of the heat exchanger tubes belonging to the upstream section is larger than the number of the heat exchanger tubes belonging to the downstream section, the heat exchanger tubes are arranged horizontally, and the position of uppermost heat exchanger tubes in the upstream section is higher than the position of uppermost heat exchanger tubes in the downstream section.

3. An evaporator comprising:

a container in which a cooling medium is applied; and a plurality of heat exchanger tubes arranged in the container in a bundled manner to form a flow passage through which a fluid to be cooled flows so as to evaporate the cooling medium by heat exchange between the cooling medium and the fluid to be cooled, wherein a total cross-sectional area of the heat exchanger tubes in a downstream section of the flow passage is smaller than a total cross-sectional area of the heat exchanger tubes in an upstream section of the flow passage, the heat exchanger tubes are arranged horizontally, and the position of uppermost heat exchanger tubes in the upstream section is higher than the position of uppermost heat exchanger tubes in the downstream section.

4. A refrigerator comprising:

an evaporator according to claim 3:

a compressor which compresses a vaporized cooling medium;

a condenser which condenses and liquefies a compressed cooling medium in a vaporized state; and an expansion value which reduces a pressure of the cooling medium during a process of flowing a liquefied cooling medium to the evaporator.

5. An evaporator comprising:

a container in which a cooling medium is applied; and a plurality of heat exchanger tubes arranged in the container in a bundled manner to form a flow passage through which a fluid to be cooled flows so as to evaporate the cooling medium by heat exchange between the cooling medium and the fluid to be cooled, wherein the heat exchanger tubes in a downstream section of the flow passage at a given location are spaced from each other by a first gap, and the heat exchanger tubes in an upstream section of the flow passage at said given location are spaced from each other by a second gap being larger than the first gap.

6. A refrigerator comprising:

an evaporator according to claim 5 a compressor which compresses a vaporized cooling medium;

a condenser which condenses and liquefies a compressed cooling medium in a vaporized state; and an expansion valve which reduces a pressure of the cooling medium during a process of flowing a liquefied cooling medium to the evaporator.

7. An evaporator comprising:

a container in which a cooling medium is applied; and a plurality of heat exchanger tubes arranged in the container in a bundled manner to form a double-path flow passage through which a fluid to be cooled flows so as to evaporate the cooling medium by heat exchange between the cooling medium and the fluid to be cooled, wherein the heat exchanger tubes in a downstream section of a first path of the double-path flow passage are spaced from each other by a first gap, the heat exchanger tubes in an upstream section of a second path of the double-path flow passage are spaced from each other by a second gap being larger than the first gap, and the plurality of heat exchanger tubes has a common diameter.

8. A refrigerator comprising:

an evaporator according to claim 7;

a compressor which compresses a vaporized cooling medium;

a condenser which condenses and liquefies a compressed cooling medium in a vaporized state; and an expansion valve which reduces a pressure of the cooling medium during a process of flowing a liquefied cooling medium to the evaporator.

9. An evaporator comprising:

a container in which a cooling medium is applied; and a plurality of heat exchanger tubes arranged in the container in a bundled manner to form a flow passage through which a fluid to be cooled flows so as to evaporate the cooling medium by heat exchange between the cooling medium and the fluid to be cooled, wherein the heat exchanger tubes in a downstream section of the flow passage are spaced from each other by a first gap, the heat exchanger tubes in an upstream section of the flow passage are spaced from each other by a second gap being larger than the first gap, the heat exchanger tubes are arranged horizontally, and the position of uppermost heat exchanger tubes in the upstream section is higher than the position of uppermost heat exchanger tubes in the downstream section.

10. A refrigerator comprising:

an evaporator according to claim 9 a compressor which compresses a vaporized cooling medium;

a condenser which condenses and liquefies a compressed cooling medium in a vaporized state; and an expansion valve which reduces a pressure of the cooling medium during a process of flowing a liquefied cooling medium to the evaporator.

* * * * *